US010654066B1

(12) United States Patent
Carpenter

(10) Patent No.: US 10,654,066 B1
(45) Date of Patent: May 19, 2020

(54) PAINT BOOTH AND METHOD FOR PAINTING AUTOMOBILES AND OTHER PRODUCTS

(71) Applicant: Barry Michael Carpenter, Sugarland, TX (US)

(72) Inventor: Barry Michael Carpenter, Sugarland, TX (US)

( * ) Notice: Subject to any disclaimer, the term of this patent is extended or adjusted under 35 U.S.C. 154(b) by 895 days.

(21) Appl. No.: 14/212,816

(22) Filed: Mar. 14, 2014

Related U.S. Application Data

(60) Provisional application No. 61/782,005, filed on Mar. 14, 2013.

(51) Int. Cl.
*B05B 16/60* (2018.01)
*F04D 25/06* (2006.01)
*F04D 27/00* (2006.01)

(52) U.S. Cl.
CPC ..... *B05B 16/60* (2018.02); *F04D 25/06* (2013.01); *F04D 27/004* (2013.01)

(58) Field of Classification Search
CPC ..... F26B 3/305
USPC ..... 34/270
See application file for complete search history.

(56) References Cited

U.S. PATENT DOCUMENTS 5,588,830 A * 12/1996 Josefsson ..... F26B 3/283 34/476
6,035,547 A * 3/2000 Hess ..... F26B 21/06 34/270
2002/0119254 A1* 8/2002 DeRegge ..... B05B 16/60 427/378
2005/0229921 A1* 10/2005 Krupp ..... B05B 16/60 126/298
2011/0010961 A1* 1/2011 Wehrheim ..... D06F 58/04 34/549
2015/0354889 A1* 12/2015 Hunter ..... F26B 3/02 34/212

* cited by examiner

*Primary Examiner* — David J Laux
*Assistant Examiner* — Bao D Nguyen
(74) *Attorney, Agent, or Firm* — FisherBroyles, LLP; Thomas J. Osborne, Jr.

(57) ABSTRACT

The present inventions relate to an improved paint booth for drying water-based and solvent-based coatings applied to a vehicle. The paint booth provides a flash cycle for drying water-based coatings. The paint booth has an enclosure in which the vehicle may be placed, the enclosure having intake and exhaust outlets for an airflow. The paint booth also has one or more blower assemblies, the one or more blower assemblies for supplying the airflow in the intake. Each of said one or more blower assemblies includes a blower and a first three-phase AC motor. The first AC motor being controlled by a variable frequency drive controller. The paint booth also has one or more exhaust fan assemblies, the exhaust fan assembly including a fan and a second three-phase AC motor. The second AC motor is controlled by a variable frequency drive controller. All of the at least one exhaust fan assemblies provide an airflow substantially equal to the airflow provided by the one or more blower assemblies with a slightly positive pressure in the enclosure during drying. Each of the controllers controlling the AC motors use lower frequencies to provide the desired airflow through the enclosure through the intake and exhaust outlets at no more than 85% of the maximum power output.

3 Claims, 7 Drawing Sheets

MODEL BAF, BELT DRIVE RATING TABLES WITH CAST ALUMINUM PROPS (Cont'd)

CFM and BHP at Static Pressure Shown • Ratings at 70° F., .075 Density, Sea Level Performance shown is for installation type D-Ducted inlet, Ducted outlet. Power rating (BHP) does not include drive losses.

Performance ratings do not include the effects of appurtenances in the air stream.

| FAN SIZE | PROP NO. | FAN RPM | 1/4" SP | | 1/2" SP | | 3/4" SP | | 1" SP | | 1 1/4" SP | | 1 1/2" SP | | 1 3/4" SP | | 2" SP | | 2 1/4" SP | |
|---|---|---|---|---|---|---|---|---|---|---|---|---|---|---|---|---|---|---|---|---|
| | | | CFM | BHP | CFM | BHP | CFM | BHP | CFM | BHP | CFM | BHP | CFM | BHP | CFM | BHP | CFM | BHP | CFM | BHP |
| 24" | 24-6-31 | 1471 | 6229 | .61 | 5612 | .64 | 4602 | .64 | 2273 | .70 | | | | | | | | | | |
| | | 1617 | 6951 | .80 | 6423 | .84 | 5742 | .85 | 4257 | .85 | 2315 | .94 | 1457 | 1.01 | | | | | | |
| | | 1863 | 8149 | 1.21 | 7711 | 1.26 | 7221 | 1.29 | 6602 | 1.30 | 5555 | 1.29 | 3372 | 1.38 | 2363 | 1.47 | | | | |
| | 24-4-25A ● | 1548 | 6369 | .82 | 5812 | .83 | 4985 | .79 | | | | | | | | | | | | |
| | | 1960 | 8256 | 1.60 | 7853 | 1.65 | 7407 | 1.66 | 6861 | 1.63 | 6019 | 1.56 | | | | | | | | |
| | | 2275 | 9752 | 2.51 | 9415 | 2.58 | 9061 | 2.62 | 8675 | 2.63 | 8232 | 2.61 | 7676 | 2.55 | 6793 | 2.46 | | | | |
| | 24-4-20A ● | 1604 | 5778 | .62 | 5229 | .64 | 4488 | .63 | 2818 | .61 | 1873 | .65 | | | | | | | | |
| | | 1750 | 6391 | .80 | 5910 | .83 | 5328 | .83 | 4465 | .81 | 2522 | .80 | 1118 | .84 | | | | | | |
| | | 2054 | 7647 | 1.28 | 7255 | 1.32 | 6826 | 1.34 | 6328 | 1.35 | 5686 | 1.33 | 4648 | 1.29 | 2770 | 1.30 | 1561 | 1.35 | 663 | 1.41 |
| | | 2200 | 8243 | 1.56 | 7881 | 1.62 | 7495 | 1.65 | 7065 | 1.66 | 6556 | 1.65 | 5891 | 1.63 | 4810 | 1.59 | 3814 | 1.59 | 1835 | 1.65 |
| | | 2567 | 9728 | 2.46 | 9423 | 2.53 | 9107 | 2.58 | 8774 | 2.61 | 8415 | 2.63 | 8016 | 2.63 | 7554 | 2.62 | 6986 | 2.58 | 6204 | 2.55 |
| | 24-4-33 | 1240 | 6120 | .54 | 5584 | .59 | 4871 | .63 | | | | | | | | | | | | |
| | | 1392 | 6993 | .76 | 6524 | .81 | 6009 | .86 | 5252 | .89 | | | | | | | | | | |
| | | 1631 | 8350 | 1.20 | 7942 | 1.25 | 7540 | 1.31 | 7089 | 1.37 | 6542 | 1.42 | | | | | | | | |
| | | 1823 | 9430 | 1.66 | 9055 | 1.71 | 8689 | 1.78 | 8334 | 1.85 | 7933 | 1.92 | 7453 | 1.97 | 6752 | 1.99 | | | | |
| | | 2074 | 10834 | 2.43 | 10490 | 2.48 | 10172 | 2.55 | 9860 | 2.63 | 9539 | 2.71 | 9198 | 2.79 | 8818 | 2.86 | 8363 | 2.92 | 7732 | 2.94 |
| 30" | 30-6-22 | 1205 | 8495 | .83 | 7495 | .85 | 4807 | .83 | 2436 | .86 | 1331 | .91 | | | | | | | | |
| | | 1383 | 9996 | 1.25 | 9196 | 1.28 | 8183 | 1.29 | 5232 | 1.24 | 3089 | 1.28 | 2068 | 1.34 | 1115 | 1.40 | | | | |
| | | 1562 | 11397 | 1.76 | 10701 | 1.78 | 9935 | 1.82 | 8913 | 1.83 | 6062 | 1.76 | 3806 | 1.79 | 2791 | 1.86 | 1957 | 1.93 | 1064 | 1.95 |
| | 30-7-37 | 953 | 10084 | 1.12 | 9229 | 1.19 | 4994 | 1.01 | 3325 | 1.11 | 2383 | 1.24 | 1602 | 1.36 | 848 | 1.47 | | | | |
| | | 1066 | 11423 | 1.54 | 10775 | 1.64 | 9669 | 1.67 | 5024 | 1.43 | 3724 | 1.55 | 2860 | 1.69 | 2136 | 1.83 | 1462 | 1.97 | 776 | 2.09 |
| | | 1226 | 13287 | 2.30 | 12788 | 2.43 | 12134 | 2.52 | 11071 | 2.54 | 6340 | 2.15 | 4865 | 2.26 | 3965 | 2.42 | 3246 | 2.59 | 2612 | 2.75 |
| | | 1475 | 16148 | 3.94 | 15772 | 4.10 | 15336 | 4.24 | 14810 | 4.36 | 14121 | 4.43 | 13019 | 4.39 | 8174 | 3.74 | 6538 | 3.83 | 5588 | 4.00 |
| 34" | 34-6-29 | 1266 | 12338 | 1.30 | 10703 | 1.29 | 7828 | 1.30 | 4452 | 1.47 | 2263 | 1.56 | | | | | | | | |
| | | 1370 | 13565 | 1.53 | 12174 | 1.64 | 10112 | 1.62 | 6722 | 1.74 | 4118 | 1.91 | 2171 | 1.98 | | | | | | |
| | | 1608 | 16307 | 2.61 | 15238 | 2.66 | 13940 | 2.65 | 12167 | 2.62 | 9442 | 2.69 | 6630 | 2.83 | 4636 | 3.10 | 2981 | 3.19 | 1209 | 3.22 |
| | | 1795 | 18420 | 3.61 | 17504 | 3.69 | 16461 | 3.71 | 15204 | 3.68 | 13551 | 3.64 | 11184 | 3.70 | 8476 | 3.95 | 6386 | 4.19 | 4748 | 4.34 |
| | 34-6-26 | 953 | 12763 | 1.21 | 11767 | 1.29 | 10362 | 1.30 | 5525 | 1.22 | 3257 | 1.35 | 2061 | 1.46 | | | | | | |
| | | 1061 | 14401 | 1.64 | 13558 | 1.75 | 12534 | 1.80 | 11006 | 1.79 | 5987 | 1.69 | 3891 | 1.84 | 2719 | 1.96 | | | | |
| | | 1228 | 16898 | 2.48 | 16204 | 2.63 | 15434 | 2.74 | 14526 | 2.79 | 13325 | 2.79 | 11027 | 2.67 | 6136 | 2.68 | 4549 | 2.84 | 3488 | 2.99 |
| | | 1472 | 20497 | 4.18 | 19937 | 4.39 | 19347 | 4.55 | 18711 | 4.68 | 18006 | 4.77 | 17193 | 4.82 | 16191 | 4.81 | 14766 | 4.73 | 11214 | 4.48 |
| 36" | 36-6-26 | 980 | 14768 | 1.56 | 13738 | 1.64 | 12517 | 1.69 | 10344 | 1.65 | 4923 | 1.65 | 3421 | 1.81 | 2196 | 1.95 | | | | |
| | | 1143 | 17549 | 2.41 | 16659 | 2.53 | 15748 | 2.62 | 14696 | 2.68 | 13216 | 2.67 | 7676 | 2.48 | 5433 | 2.66 | 4169 | 2.85 | 3107 | 3.02 |
| | | 1378 | 21510 | 4.14 | 20749 | 4.31 | 20016 | 4.45 | 19267 | 4.57 | 18460 | 4.65 | 17531 | 4.70 | 16341 | 4.70 | 14241 | 4.57 | 8460 | 4.40 |
| 42" | 42-6-26 | 831 | 17850 | 1.57 | 15950 | 1.64 | 12841 | 1.62 | 6967 | 1.57 | 4038 | 1.70 | 1265 | 1.82 | | | | | | |
| | | 942 | 20944 | 2.33 | 19419 | 2.43 | 17546 | 2.49 | 14513 | 2.44 | 8984 | 2.35 | 5949 | 2.47 | 3735 | 2.63 | 1010 | 2.76 | | |
| | | 1144 | 25997 | 4.10 | 24801 | 4.25 | 23515 | 4.37 | 22037 | 4.44 | 20158 | 4.45 | 17241 | 4.36 | 12361 | 4.20 | 9094 | 4.29 | 6930 | 4.46 |

● THESE PROP NUMBERS, WITH AN 'A' SUFFIX LETTER, ARE MULTI-PIECE PROPS. ALL OTHERS ARE ONE-PIECE PROPS

FIGURE 3

MODEL BAF, BELT DRIVE RATING TABLES WITH CAST ALUMINUM PROPS (Cont'd)

CFM and BHP at Static Pressure Shown • Ratings at 70° F., .075 Density, Sea Level Performance shown is for installation type D-Ducted inlet, Ducted outlet. Power rating (BHP) does not include drive losses.

Performance ratings do not include the effects of appurtenances in the air stream.

| FAN SIZE | PROP NO. | FAN RPM | 1/8" SP | | 1/4" SP | | 3/8" SP | | 1/2" SP | | 3/4" SP | | 3/4" SP | | 7/8" SP | | 1" SP | | 1 1/8" SP | |
|---|---|---|---|---|---|---|---|---|---|---|---|---|---|---|---|---|---|---|---|---|
| | | | CFM | BHP | CFM | BHP | CFM | BHP | CFM | BHP | CFM | BHP | CFM | BHP | CFM | BHP | CFM | BHP | CFM | BHP |
| 24" | 24-6-31 | 1471 | 6229 | .61 | 5612 | .64 | 4602 | .64 | 2273 | .70 | | | | | | | | | | |
| | | 1617 | 6951 | .80 | 6423 | .84 | 5742 | .85 | 4257 | .85 | 2315 | .94 | 1457 | 1.01 | | | | | | |
| | | 1863 | 8149 | 1.21 | 7711 | 1.26 | 7221 | 1.29 | 6602 | 1.30 | 5555 | 1.29 | 3372 | 1.38 | 2363 | 1.47 | | | | |
| | 24-4-25A ● | 1548 | 6369 | .82 | 5812 | .83 | 4985 | .79 | | | | | | | | | | | | |
| | | 1960 | 8256 | 1.60 | 7853 | 1.65 | 7407 | 1.66 | 6861 | 1.63 | 6019 | 1.56 | | | | | | | | |
| | | 2275 | 9752 | 2.51 | 9415 | 2.58 | 9061 | 2.62 | 8675 | 2.63 | 8232 | 2.61 | 7676 | 2.55 | 6793 | 2.46 | | | | |
| | 24-4-20A ● | 1604 | 5778 | .62 | 5229 | .64 | 4488 | .63 | 2818 | .61 | 1873 | .65 | | | | | | | | |
| | | 1750 | 6391 | .80 | 5910 | .83 | 5328 | .83 | 4465 | .81 | 2522 | .80 | 1118 | .84 | | | | | | |
| | | 2054 | 7647 | 1.28 | 7255 | 1.32 | 6826 | 1.34 | 6328 | 1.35 | 5686 | 1.33 | 4648 | 1.29 | 2770 | 1.30 | 1561 | 1.35 | 663 | 1.41 |
| | | 2200 | 8243 | 1.56 | 7881 | 1.62 | 7495 | 1.65 | 7065 | 1.66 | 6556 | 1.65 | 5891 | 1.63 | 4810 | 1.59 | 3914 | 1.59 | 1835 | 1.65 |
| | | 2567 | 9728 | 2.46 | 9423 | 2.53 | 9107 | 2.58 | 8774 | 2.61 | 8415 | 2.63 | 8016 | 2.63 | 7554 | 2.62 | 6986 | 2.58 | 6204 | 2.55 |
| | 24-4-33 | 1240 | 6120 | .54 | 5584 | .59 | 4871 | .63 | | | | | | | | | | | | |
| | | 1392 | 6993 | .76 | 6524 | .81 | 6009 | .86 | 5252 | .89 | | | | | | | | | | |
| | | 1631 | 8350 | 1.20 | 7942 | 1.25 | 7540 | 1.31 | 7089 | 1.37 | 6542 | 1.42 | | | | | | | | |
| | | 1823 | 9430 | 1.66 | 9055 | 1.71 | 8689 | 1.78 | 8334 | 1.85 | 7933 | 1.92 | 7453 | 1.97 | 6752 | 1.99 | | | | |
| | | 2074 | 10834 | 2.43 | 10490 | 2.48 | 10172 | 2.55 | 9860 | 2.63 | 9539 | 2.71 | 9198 | 2.79 | 8818 | 2.86 | 8363 | 2.92 | 7732 | 2.94 |
| 30" | 30-6-22 | 1205 | 8495 | .83 | 7495 | .85 | 4807 | .83 | 2436 | .86 | 1331 | .91 | | | | | | | | |
| | | 1383 | 9996 | 1.25 | 9196 | 1.28 | 8183 | 1.29 | 5232 | 1.24 | 3089 | 1.28 | 2068 | 1.34 | 1115 | 1.40 | | | | |
| | | 1562 | 11397 | 1.76 | 10701 | 1.79 | 9935 | 1.82 | 8913 | 1.83 | 6062 | 1.76 | 3806 | 1.79 | 2791 | 1.86 | 1957 | 1.93 | 1064 | 1.95 |
| | 30-7-37 | 953 | 10084 | 1.12 | 9229 | 1.19 | 4994 | 1.01 | 3325 | 1.11 | 2383 | 1.24 | 1602 | 1.36 | 848 | 1.47 | | | | |
| | | 1066 | 11423 | 1.54 | 10775 | 1.64 | 9669 | 1.67 | 5024 | 1.43 | 3724 | 1.55 | 2860 | 1.69 | 2136 | 1.83 | 1462 | 1.97 | 776 | 2.09 |
| | | 1226 | 13287 | 2.30 | 12788 | 2.43 | 12134 | 2.52 | 11071 | 2.54 | 6340 | 2.15 | 4865 | 2.26 | 3965 | 2.42 | 3246 | 2.59 | 2612 | 2.75 |
| | | 1475 | 16148 | 3.94 | 15772 | 4.10 | 15336 | 4.24 | 14810 | 4.36 | 14121 | 4.43 | 13019 | 4.39 | 8174 | 3.74 | 6538 | 3.83 | 5588 | 4.00 |
| 34" | 34-6-29 | 1266 | 12338 | 1.30 | 10703 | 1.29 | 7828 | 1.30 | 4452 | 1.47 | 2263 | 1.56 | | | | | | | | |
| | | 1370 | 13565 | 1.53 | 12174 | 1.64 | 10112 | 1.62 | 6722 | 1.74 | 4118 | 1.91 | 2171 | 1.98 | | | | | | |
| | | 1608 | 16307 | 2.61 | 15238 | 2.66 | 13940 | 2.65 | 12167 | 2.62 | 9442 | 2.69 | 6630 | 2.93 | 4636 | 3.10 | 2981 | 3.19 | 1209 | 3.22 |
| | | 1795 | 18420 | 3.61 | 17504 | 3.69 | 16461 | 3.71 | 15204 | 3.68 | 13551 | 3.64 | 11184 | 3.70 | 8476 | 3.95 | 6386 | 4.19 | 4748 | 4.34 |
| | 34-6-26 | 953 | 12763 | 1.21 | 11767 | 1.29 | 10362 | 1.30 | 5525 | 1.22 | 3257 | 1.35 | 2061 | 1.46 | | | | | | |
| | | 1061 | 14401 | 1.64 | 13558 | 1.75 | 12534 | 1.80 | 11006 | 1.79 | 5987 | 1.69 | 3891 | 1.84 | 2719 | 1.96 | | | | |
| | | 1228 | 16898 | 2.48 | 16204 | 2.63 | 15434 | 2.74 | 14526 | 2.79 | 13325 | 2.79 | 11027 | 2.67 | 6136 | 2.68 | 4549 | 2.84 | 3488 | 2.99 |
| | | 1472 | 20497 | 4.18 | 19937 | 4.39 | 19347 | 4.55 | 18711 | 4.68 | 18006 | 4.77 | 17193 | 4.82 | 16191 | 4.81 | 14766 | 4.73 | 11214 | 4.48 |
| 36" | 36-6-26 | 980 | 14768 | 1.56 | 13738 | 1.64 | 12517 | 1.69 | 10344 | 1.65 | 4923 | 1.65 | 3421 | 1.81 | 2196 | 1.95 | | | | |
| | | 1143 | 17549 | 2.41 | 16659 | 2.53 | 15748 | 2.62 | 14696 | 2.68 | 13216 | 2.67 | 7676 | 2.48 | 5433 | 2.66 | 4169 | 2.85 | 3107 | 3.02 |
| | | 1378 | 21510 | 4.14 | 20749 | 4.31 | 20016 | 4.45 | 19267 | 4.57 | 18460 | 4.65 | 17531 | 4.70 | 16341 | 4.70 | 14241 | 4.57 | 8460 | 4.40 |
| 42" | 42-6-26 | 831 | 17850 | 1.57 | 15950 | 1.64 | 12841 | 1.62 | 6967 | 1.57 | 4038 | 1.70 | 1265 | 1.82 | | | | | | |
| | | 942 | 20944 | 2.33 | 19419 | 2.43 | 17546 | 2.49 | 14513 | 2.44 | 8984 | 2.35 | 5949 | 2.47 | 3735 | 2.63 | 1010 | 2.76 | | |
| | | 1144 | 25997 | 4.10 | 24801 | 4.25 | 23515 | 4.37 | 22037 | 4.44 | 20158 | 4.45 | 17241 | 4.36 | 12361 | 4.20 | 9094 | 4.29 | 6930 | 4.46 |

● THESE PROP NUMBERS, WITH AN 'A' SUFFIX LETTER, ARE MULTI-PIECE PROPS. ALL OTHERS ARE ONE-PIECE PROPS

FIGURE 5

INTAKE VFD
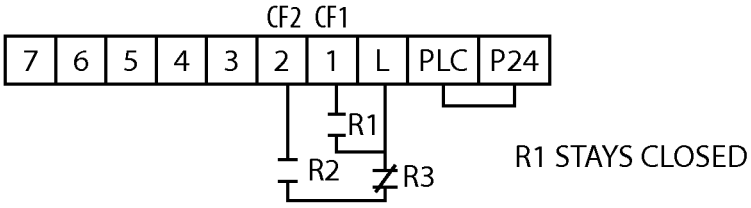
A001 = 01
A002 = 01 A020 = 40
A061 = 50 A021 = 46
A062 = 40
B037 = 00
C001 = 00
C002 = 02
C026 = 01
| | CF4 | CF3 | CF2 | CF1 |
|---|---|---|---|---|
| RUN | | | | 1 |
| FLASH | | | 1 | 1 |
EXHAUST VFD
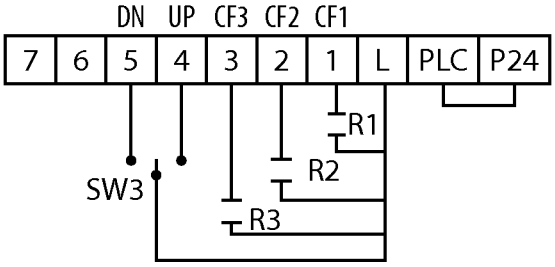
| | CF4 | CF3 | CF2 | CF1 |
|---|---|---|---|---|
| RUN | | | | 1 |
| 1SP | | | 1 | 1 |
| 2SP | | 1 | | 1 |
| SAME SPEED AS 2SP | | 1 | 1 | 1 |
A001 = 01 B037 = 00
A002 = 01 C001 = 00
A020 = 40 C002 = 02
A021 = 46 C003 = 03
A022 = 18 C004 = 27
A061 = 50 C005 = 28
A062 = 10 C101 = 01
FIG. 6

MIN

35 HTZ 13A

| | | | |
|---|---|---|---|
| 2500 | 3400 | 3600 | 3000 |
| 2200 | 2700 | 3400 | 2500 |

AVG = 2912.5 $FT^2$MIN
AREA = 3.55 $FT^2$
CFM = 10339.37

MAX

60 HTZ 30A

| | | | |
|---|---|---|---|
| 4700 | 5000 | 6400 | 5200 |
| 3900 | 5200 | 6300 | 4200 |

AVG = 5112.5 $FT^2$MIN
AREA = 3.55 $FT^2$
CFM = 18149.37 CFM

SMALL BOOTH

40 HTZ 16A

| | | | |
|---|---|---|---|
| 2800 | 3100 | 4200 | 3200 |
| 2500 | 3800 | 3800 | 2700 |

AVG = 3265 $FT^2$MIN
AREA = 3.55 $FT^2$
CFM = 11593.85

47 HTZ 20A

| | | | |
|---|---|---|---|
| 3800 | 3900 | 5100 | 3700 |
| 3100 | 3400 | 4900 | 3200 |

AVG = 3887.5 $FT^2$MIN
AREA = 3.55 $FT^2$
CFM = 13,800

FIG. 7

PAINT BOOTH AND METHOD FOR PAINTING AUTOMOBILES AND OTHER PRODUCTS

CROSS-REFERENCE TO RELATED APPLICATIONS

This application claims the benefit of United States provisional application no. 61/782,005, filed Mar. 13, 2013, which is hereby incorporated by reference as though fully set forth herein.

BACKGROUND

Field

The present inventions relate to a new and improved environmentally controlled paint booth and methods for painting vehicles and other products.

Background

Environmentally controlled booths have been used to cure paint for some time. See e.g., U.S. Pat. No. 6,035,547. There has been a trend in recent years to use water-based as opposed to solvent-based paints. This has been driven in part by federal regulations. Water-based paints have a different curing cycles than solvent-based paints. For example, solvent-based paints are typically cured using higher temperatures and less airflow than water-based paints. Water-based paints typically need more airflow to cure than solvent-based paints. Furthermore, water-based paints typically benefit from a "flash" step wherein the airflow is increased for period of time. See U.S. Pat. No. 6,035,547. In addition, in recent years, with energy costs rising, there has been an increased demand for energy efficient paint booths. In many body shops, solvent-based coatings are still the majority of coatings used, yet the use of water-based coating is increasing. Nevertheless, the clear coat, for example, that is applied after the primary paint, is typically solvent-based. Therefore, there is a need for a universal paint booth that is capable of handling all steps in the painting of an automobile, such as the type of paint booth found in body shop as opposed to an assembly line environment, that is capable of curing solvent and water-based coating, and that is energy efficient.

SUMMARY

The paint booth and methods disclosed herein overcome the deficiencies in existing paint booth designs and methods of using same. One implementation provides a paint booth that can provide a "flash" step for curing by providing a period of time of increased airflow, while also providing the standard airflow for curing solvent-based paints. In one implementation, for example, a new and improved design is utilized that includes an oversized fan or blower in combination with a variable frequency drive controller, also known as a variable frequency drive, variable frequency controller, or inverter drive. The fan or blower is oversized in comparison to the size that might ordinarily be used for the likely output and is capable of an output or airflow larger than what is likely to ever be needed. The use of a variable frequency drive in combination with an oversized fan allows significant savings in energy as the fan or blower may be run at a fraction of its maximum output. In addition, an oversized fan or blower allows for scalability in the event that larger airflows are desired. The frequency drive allows the fan or blower to be run at a small fraction of its maximum output to provide the lower airflows used in curing solvent-based paints. The advantages of variable frequency drives over other means for controlling speed in electric motors, such as through variable resistance, are well known.

In addition to the improved paint booth design described herein, a novel and improved method is also disclosed for curing water-based coatings, and, namely, automotive paints. As shown in the '547 patent cited above, for example, it is well known that, to cure a subject having been sprayed with a water-based paint, it is desirable to "flash" the coating. Different coatings require different curing parameters, but it is desirable in non-assembly line setting to have an environmentally controlled booth that is capable of first preheating an object, such as a car, prior to application. During application, it is desirable to have positive pressure inside the booth to prevent the entry of dust and other contaminants. It is also desirable to have sufficient airflow during spraying to remove the overspray. Once a coating has been applied, it is typically desirable to raise the temperature above the ambient temperature or above the temperature of the object at the time of spraying, and for a period of time apply a flow of air at the increased temperature. After a period of time and once the water-based paint has dried, it is common to apply a solvent-based clear coat. Again, during the application of the clear coat, it is desirable to have a positive pressure in the booth to prevent the entry of dust and other contaminants. Once the clear coat has been applied, it is then typically desirable to raise the temperature inside the booth to a temperature higher than previously used with the water-based coating. However, airflow is less important. Therefore, also disclosed herein is a novel and improved method for painting an object including an automobile in an environmentally controlled paint booth that includes the steps of providing a positive pressure to facilitate spraying of a water-based coating on the object with some airflow, providing a slightly increased airflow and a raised temperature to dry the water-based coating for a period of time, providing a cool down cycle, providing positive pressure to facilitate the spraying of a clear coat, providing a temperature that is higher and an airflow that is slower than during the previous dry cycle to cure the clear coat.

DESCRIPTION OF THE DRAWINGS

FIG. 3 shows an example table representing performance of an example fan.

FIG. 5 shows an example table representing performance of an example fan.

FIG. 6 shows typical settings for the frequency drives in one implementation of an exemplar paint booth described herein.

FIG. 7 shows typical airflows and power consumption of one implementation of an exemplar paint booth described herein

DETAILED DESCRIPTION

Figure 1:
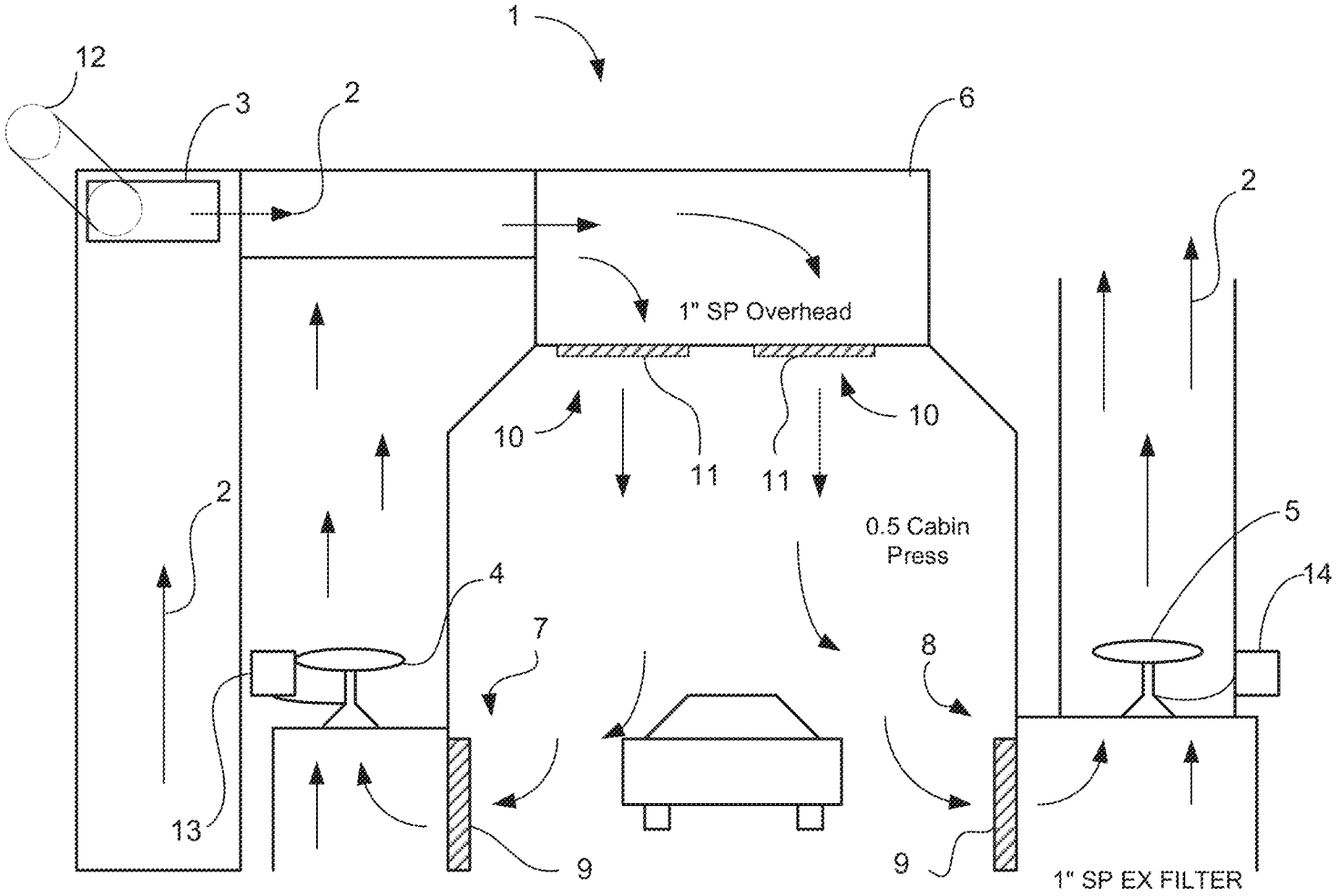
FIG. 1 shows an end view of an exemplar paint booth embodying one example of the invention(s).

One version of the paint booth of the present invention is shown in FIG. 1, although many other configurations are possible. FIG. 1 shows the end view of a paint booth 1 in which an airflow 2 is provided by both a blower 3 and a pair of exhaust fans 4, 5. The booth 1 is a "side draft" booth. The inventions claimed herein are equally useful with downdraft, cross-draft, and any other similar paint booth as the particular air-flow path is not important to the claimed inventions. As shown in FIG. 1, the pattern of the airflow 2 provided by the blower 3 and pair of exhaust fans 4, 5 is from the top 6 of the booth through an inlet 10 downward and toward the sides 7, 8. The blower 3 is driven by an AC motor 12 connected to the blower 3 by a belt around pulleys. The blower 3, AC motor 12, pulleys, belts and related well-known hardware constitute a blower assembly. The fans 4, 5 are driven by AC fan motors 13, 14 connected to the fans 4, 5 by a belt around pulleys. Each of the fans 4,5, AC fan motors 13, 14, belts, pulleys and related well known hardware constitute fan assemblies. An alternative implementation would consist of a flow in which the exhaust from the booth is through the floor, which would, after passing through the floor, be directed typically upward. In both configurations, the airflow 2 at the inlet 10 would typically pass through filters 11, and the exhaust would typically pass through filters 9 in order remove certain contaminants in the exhaust air, and then out through an exhaust vent, in, for example, the roof of a larger building or enclosure housing the paint booth.

Downdraft, side draft, and similar paint booths are well known in the art. However, prior art systems to date have been typically designed primarily to facilitate the drying of volatile or solvent-based paint. As previously explained, water-based paints typically require a higher airflow. To increase the airflow in prior art systems, the power supplied to the fan(s) and/or blower(s) powered by AC motors would typically be increased. However, in such prior art systems, in order to avoid the added expense of oversized hardware, the AC motors would typically be run at near maximum capacity when such systems would be used in connection with drying air drying paints. One novel aspect of the present invention is that significance operating costs are saved by using larger AC motors and running them, using a variable frequency drive, also known as an inverter, at 70-90% of capacity, and most advantageously, between 75-85% full capacity. In sizing the fans and using a frequency drive controller in this manner, significant savings in the costs of electrical power are obtained due to the overall lower power consumption of the oversized AC motors controlled in the manner described herein.

A typical variable frequency drive, also known as an inverter, is made by Hitachi Industrial Equipment Systems Co., Ltd., WJ200 Series. The WJ200 Series includes various sizes of inverters. A typical WJ200 Series inverter is programmable to control ramp-up rate, such as 0-60 Hz over a period of time. To lessen wear on the system and for optimal energy efficiency, a typical ramp-up rate would from zero to an operating frequency over a minute. The operation of a frequency drive or inverter is well known. In essence, the digital controller takes in three-phase current, for example, at 240 or 480 volts and sixty hertz, and outputs a different waveform at the same voltage. By adjusting frequency, the variable frequency drive controls the output power and thereby control the speed of the motors driving the fan(s) and/or blower(s).

In prior art systems, the speed of the motors driving the fan(s) and/or blower(s) would be controlled by the sizing of the mechanical drives, such as the ratio the diameters of the pulleys, or through adding variable resistance in the electrical circuit. A frequency drive or inverter provides the ability to quickly change motor speeds and thereby airflows.

Referring to FIG. 1, a typical design for a side-draft paint booth 1 having one inlet blower 3 and two exhaust fans 4,5 is described as follows. It is well known in the art that it is desirable to have a slightly positive pressure, known as static pressure, inside the paint booth. A typical static pressure would be in the range of 0.05 in. wg. at all airflows. In a blower 3 and two fan 4,5 system for a typical side draft paint booth 1 such as shown in FIG. 1 for an automobile, for the flash stage it would be desirable to have an airflow 2 in the range of 13-14,000 CFM. In the spray cycle(s), a typical airflow 2 would be in the range of, for example, 10-11,000 CFM. In addition, the airflow 2 at the inlet 10 is approximately the same as the total airflow 2 out, which is divided between the outlet 7 and outlet 8. Also, due to the filters 9 and 11, approximately 0.5 static pressure is present and must be overcome due to the filters. Using this exemplar system, the blower 3, fans 4, 5, and motors 12, 13, and 14 would be sized using prior art design methods assuming prior art control systems as follows. The 0.05 static positive pressure inside the booth would typically be accomplished by slightly adjusting the system once set up, as this is a relatively low pressure differential.

More specifically, in the prior art, by way of example, a designer would typically choose an electrical motors to drive the blower and fans to provide a desired airflow according to the following design guides. However, a system designed for an optimum "flash" airflow would be mis-sized for the lower "spray" airflow, and vice-versa. As will be explained below, a system designed for the higher airflow 2 for the flash phase, using variable frequency drives or inverters to control each of the motor 12 and the motors 13 and 14, can easily be adjusted to provide a lower airflow 2 for the spray phase.

Figure 2:
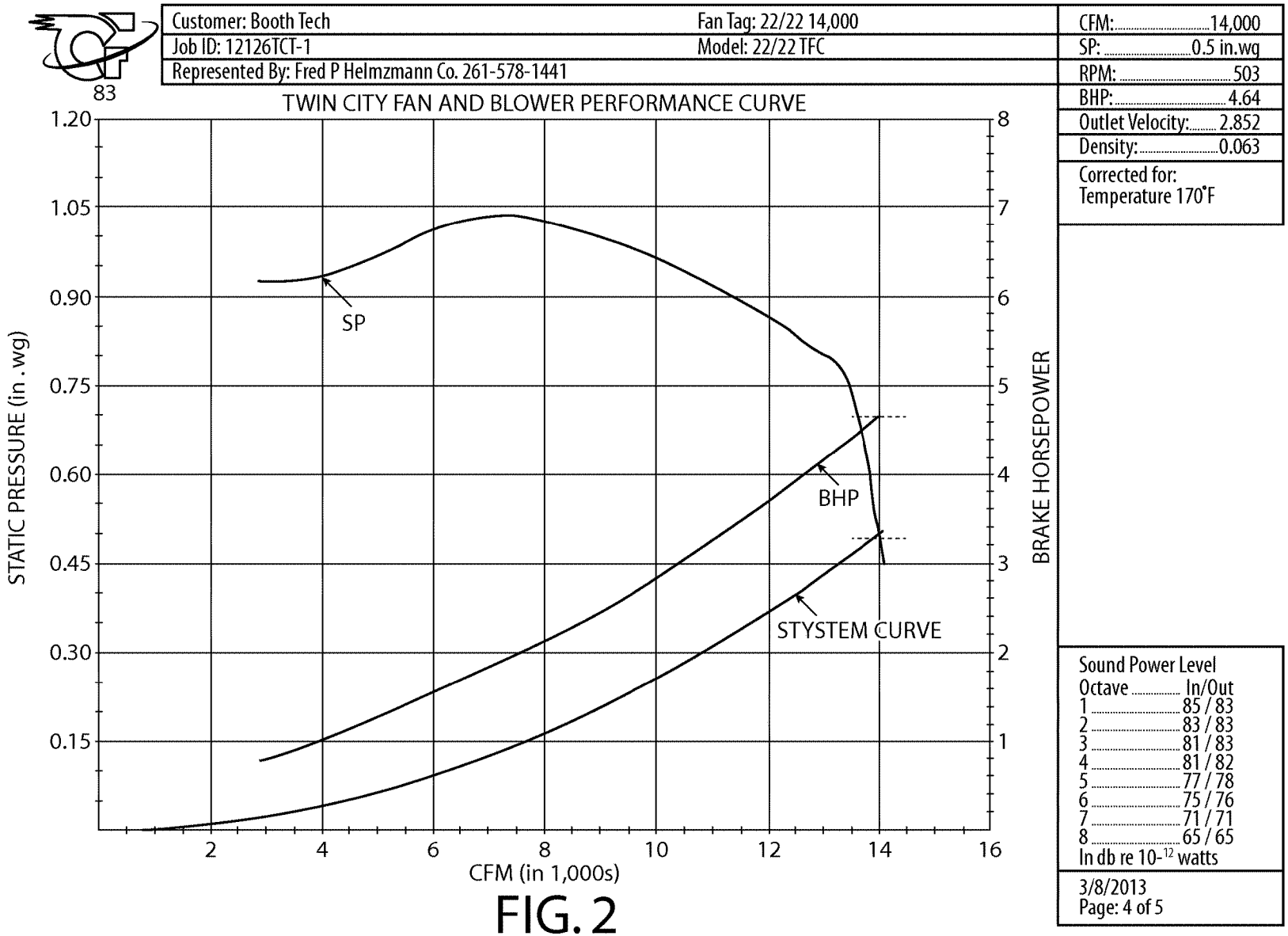
FIG. 2 shows an example curve representing the performance of an example blower.

In FIG. 2, the curves represent the performance of a particular sized blower 3. The designer would first choose a blower having the desired recommended output for flash, which, in this instance, would be 13-14,000 CFM. A designer would then utilize a table like the following for the selected blower. FIG. 2 shows a curve for a Twin City blower model 22/22 TFC, which is capable of a maximum of 14,000 CFM. This blower is a typical "squirrel cage" type blower. Other means for supplying an airflow, such as a fan or other types of blowers, could also be used. The designer would then utilize the curve of FIG. 2 to match the desired static pressure on the left hand side, and a desired CFM on the bottom, to find the correct size of a motor, shown on the right hand side:

Using the example of FIG. 1, and using the curve of FIG. 2 to choose a motor for the blower, for 0.5 static pressure to overcome the 0.5 static pressure due to the filters 11, and a 13-14000 CFM, the higher airflow for the flash phase, a motor of approximately 4.6 BHP would be needed. However, 4.6 BHP motors are not common, so the next larger size, such as 5 BHP, would typically be chosen.

Next, a designer would turn to the selection of a motor 14 for the fans 4, 5. Each fan 4, 5 must achieve about 7,000 CFM to remove the 14,000 CFM coming in the inlet 10. While some iteration would be involved, and to some degree the size of a fan is a design choice, and other sizes would work, using a chart such as shown in FIG. 3, a twenty-four inch fan, such as the 24-4-25A, would be a practical design choice since it is capable of providing the desired flow rates in view of the static pressures present in the system due to the filters 11, 7, and 8.

The filters 7, 8 would cause about 0.5 inch static pressure. Hence, as shown above, the 24-4-25A model, which is made by Cincinnati Fan, would be a good choice, as it can provide the required 7,000 CFM airflow at a 0.5 static pressure using about a 2 horsepower motor for motors 13, 14.

However, in prior art systems, it would not be possible to utilize the same blower(s) and/or fan(s) combinations for both the flash and spray cycles because prior art systems do not have controllers that run the same blower(s) and/or fan(s) at two different speeds. The use of a frequency controller is advantageous for controlling the same motors at two different speeds due to its programmability and use of variable frequency to control power, and, therefore, speed of the motors, and, hence, airflow.

One advantage to the present invention is that by using a variable frequency drive to control each of the motor 12 and the motors 13, 14, both the higher airflow for the flash mode and the lower airflow for the spray mode can be provided without changing the pulley ratios or otherwise changing the hardware.

In addition, another advantage of the present invention is that, by choosing a larger motor size and blower and fan size that what the charts above would indicate, significant energy saving can be achieved. Furthermore, it is known that the greatest energy efficiency is achieved by running a variable frequency converter (or variable frequency drive) at 60%-75% of its maximum output frequency, which is 60 hz. Sixty percent of sixty hertz is thirty-six (36) hertz. To accomplish this objective, that the system, when complete, can be run in the spray phase at about forty (40) hertz, it has been found that the blower, fans, and motors need to be oversized by about forty percent when using prior art design guidelines such as those shown above.

In the exemplar implementation shown in FIG. 1, in an implementation of the claimed invention, the desired flash cycle was 13-14,000 CFM. Adding forty percent to 13,000 results in a CFM of about 18,000. Therefore, a blower providing 18,000 CFM was chosen, which is greater than the desired 14,000 CFM for a flash cycle.

Figure 4:
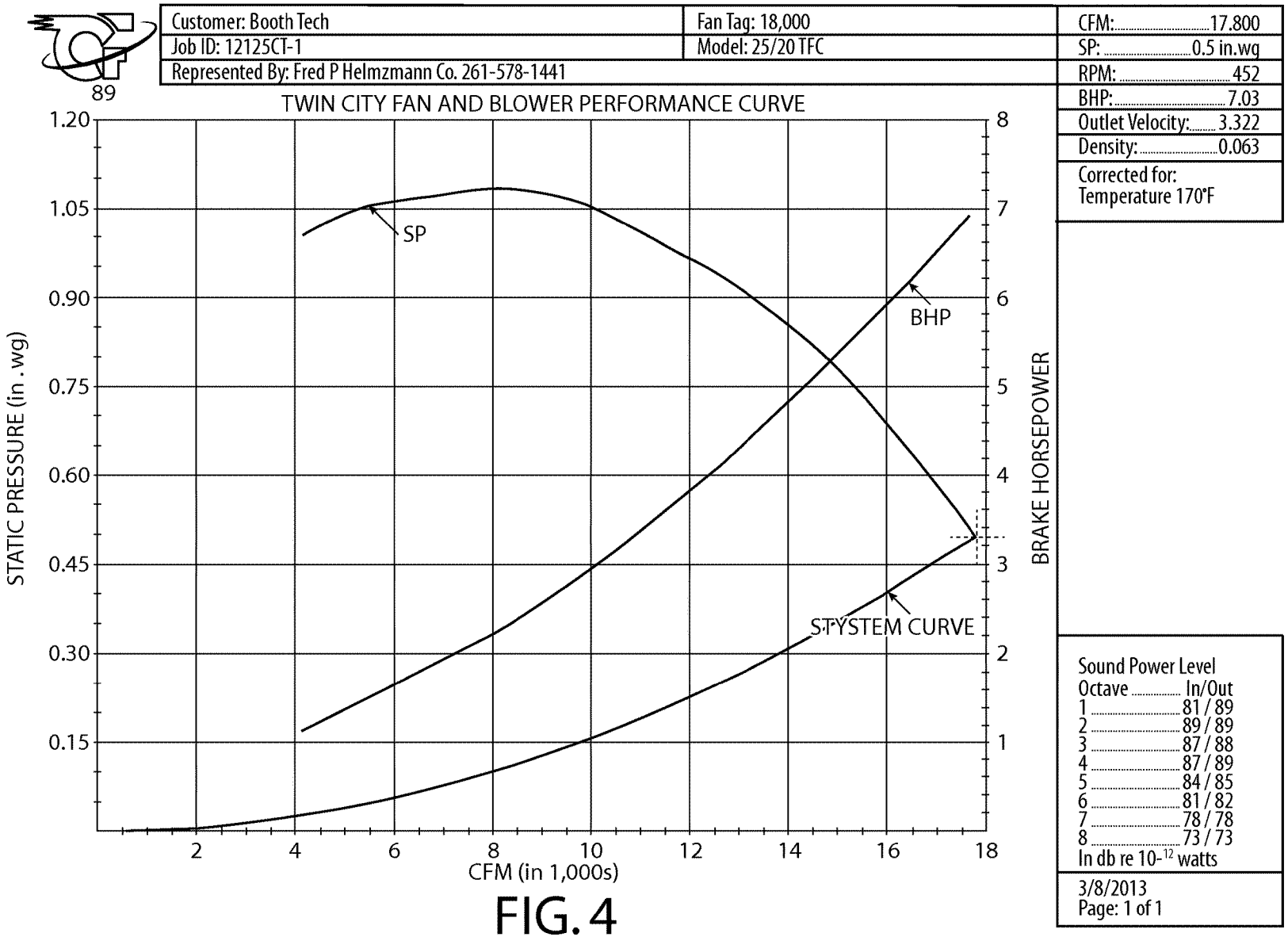
FIG. 4 shows an example curve representing the performance of an example blower.

FIG. 4 shows a curve for a Twin City blower model 25/20 TFC, which is capable of a maximum of 18,000 CFM. This blower is larger than the blow than the 22/22 TFC blower discussed above. The designer would utilize the curve in FIG. 4 to match the desired static pressure on the left hand side, and a desired CFM on the bottom, to find the correct size of a motor, shown on the right hand side:

Referring to FIG. 4, to choose the size for the motor 12, the chart above suggested a 6.5 BHP motor. Since the motors are larger than prior art design guides suggest, the motors 12, 13, 14 can be run less than their maximum operating capacity even during the maximum flash airflow mode. However, not only is the 7.5 BHP a nonstandard size, it is also desirable to add 40% to the motor sizing. Therefore, a 10 HP motor was chosen. The blower, motor 12, and frequency drive constitutes a subassembly for use with the paintbooth.

Next, a designer would turn to the selection of a motor 14 for the fans 4, 5. Again, the goal is to utilize fans and motors that are larger than necessary. Here, in this example, the oversizing was accomplished by picking a larger than necessary CFM. Since the blower was selected to be oversized, aiming for 18,000 CFM whereas only a 14,000 CFM is needed, this affects the design choices of the fans and related motors as well, resulting in the desirable oversizing. As an alternative, a designer could have instead deliberately oversized the fans and motors selected using the prior art methodology used in the example above. Here, using the 18,000 CFM parameter as a guide, each fan 4, 5 must achieve about 9,000 CFM to remove the theoretical maximum of 18,000 CFM coming in the inlet 10 (although as a design goal only 14,000 is desired). While some iteration would be involved, and to some degree the size of a fan is a design choice, and other sizes would work. Using a chart such as FIG. 5, a thirty inch fan such as a 30-7-37, would be a practical design choice since it is capable of providing the desired flow rates in view of the static pressures present in the system due to the filters 11, 7, and 8.

The filters 7, 8 would cause about 0.5 inch static pressure. Hence, as shown above, the 30-7-37 model, which is made by Cincinnati Fan, would be a good choice, as it can provide the required 9,000 CFM airflow at a 0.5 static pressure using less than a 2 horsepower motor for motors 13, 14. As stated above, the goal is to oversize the motor. Therefore, adding about 40%, a 3 HP was chosen. The fan (in an alternative implementation using one fan) or fans 4, 5, motor (in the alternative implementation) or motors 13, 14, and frequency drive discussed below constitute a subassembly to be used with a paintbooth.

To drive the ten (10) HP motor 12 and the two three horsepower motors 13 and 14, two variable frequency drives were chosen. The first was a Hitachi 10 HP drive. A single variable frequency drive, a 7.5 HP drive was chosen to run the two three horsepower motors 13. These drives were programmed to have three settings corresponding to a high volume flash cycle and a lower volume spray cycle. In addition, a even lower volume bake cycle was programmed as follows: motor 12 maintained at 40 hertz at 15 amps, 208 volts, three phase, and motors 13 and 14 utilizing 18 hertz at 4 amps, for a total of 19 amps.

By using these oversized motors, in connection with the frequency converters, significant energy savings were accomplished. Since the motors are larger than prior art design guides suggest, the motors 12, 13, 14 can be run less than their maximum operating capacity even during the maximum flash airflow mode.

In one implementation using the blower and motor sizes just specified, the following are the actual measured airflows. In a side-draft booth 1 having an internal dimensions of roughly 14 feet by 28 feet by 9 foot tall, in the flash mode, a flow of 13,800 CFM was maintained utilizing 20 amps on the motor 12 at 47 hertz and 10 amps at 37 hertz with motors 12 and 14 combined for a total of 30 amps, 208 volts, three phase. In the spray cycle, a flow of 11,593 CFM was maintained utilizing 40 hertz at 16 amps, 208 volts, three phase and 8 amps utilizing 32 Hertz with motors combined for a total of 24 amps, 208 volts, three phase.

The implementation of FIG. 1 is but of numerous configurations falling within the inventions described herein. For example, in an alternative implementation, paint booth 1 in which the fans 4, 5 are eliminated, and having a single blower 3 powered by a motor 12 to supply sufficient power to overcome not only the static pressure due to the filter 11, but the filters 7, 8 as well. Conversely, in an alternative implementation, the blower 3 is eliminated, and the paint booth 1 has a pair of fans 4, 5 with motors 13, 14 sized sufficiently to overcome the static pressure due to the filters 11. In yet an alternative implementation, the blower 3 is eliminated, and the paint booth 1 has a single fan 4 with motor 13 sized sufficiently to overcome the static pressure due to the filters 11. In all of these implementations, the motor or motors is controlled by a variable frequency controller or inverter, and also sized larger than the size suggested by the design guides such as those shown above so that in operation the motor or motors can achieve the required airflow 2 while running at no more than approximately 80-85% of their maximum duty cycle.

What is claimed is:

1. An improved energy efficient paint booth for drying coatings applied to a vehicle, the paint booth comprising:

an enclosure in which the vehicle may be placed, the enclosure having an intake inlet and at least one exhaust outlet;

one or more intake assemblies configured to supply a first predetermined airflow to provide a spray cycle and a second maximum predetermined airflow that is higher than the first predetermined airflow to provide a flash cycle in the intake inlet, each of said one or more intake assemblies including:

a first blower or fan and a first three-phase AC motor, each of which is configured to increase energy efficiency by being oversized, the first blower or fan being oversized in rated maximum airflow and the first three phase AC motor being oversized in rated horsepower, both being oversized compared to what would be needed to provide the second maximum predetermined airflow when the first AC motor is supplied with AC at sixty hertz;

the first AC motor being controlled by an inlet variable frequency drive controller, the inlet variable frequency drive controller configured to increase energy efficiency by using a first frequency of between 36 Hz and 45 Hz to provide the first predetermined airflow, and a second maximum predetermined frequency that is no more than 51 Hz to provide the second maximum predetermined airflow;

one or more exhaust assemblies, the one or more exhaust assemblies configured to supply a first predetermined airflow to provide a spray cycle and a second maximum predetermined airflow that is higher than the first predetermined airflow to provide a flash cycle in the exhaust outlet, each of the one or more exhaust assemblies including a second blower or fan and a second three-phase AC motor each of which is configured to increase energy efficiency by being oversized, the second blower or fan being oversized in rated maximum airflow and the second three phase AC motor being oversized in rated horsepower, both being oversized compared to what would be needed to provide the second maximum predetermined airflow when the second AC motor is supplied with AC at sixty hertz;

the second AC motor being controlled by an outlet variable frequency drive controller, the outlet variable frequency drive controller configured to increase energy efficiency by using a first frequency of between 32 Hz and 40 Hz or 36 Hz and 45 Hz to provide the first predetermined airflow, and a second maximum predetermined frequency that is between 37 Hz and 47 Hz to provide the second maximum predetermined airflow.

2. The improved energy efficient paint booth of claim 1, wherein the one or more intake assemblies are further configured to supply a third predetermined airflow lower than the first predetermined airflow, and the one or more exhaust assemblies are further configured to supply a third predetermined airflow lower than the first predetermined airflow.

3. An improved energy efficient paint booth for drying coatings applied to a vehicle, the paint booth comprising:

an enclosure in which the vehicle may be placed, the enclosure having at least one intake inlet and at least one exhaust outlet;

an intake air-supplying means for supplying a first predetermined airflow to provide a spray cycle and a second maximum predetermined airflow that is higher than the first predetermined airflow to provide a flash cycle in the intake inlet;

said intake air-supplying means including a first blower or fan and a first three-phase AC motor;

the intake air-supplying means being controlled by an inlet variable frequency drive controller;

said first AC motor having a maximum power output at sixty hertz and capable of providing less power at lower frequencies;

each of the blower or fan and the first AC motor configured to increase energy efficiency by being oversized, the first blower or fan being oversized in rated maximum airflow and the first three phase AC motor being oversized in rated horsepower, both being oversized compared to what would be needed to provide the second maximum predetermined airflow when the AC motor is supplied with AC at sixty hertz;

said inlet variable frequency drive controller controlling the AC motor configured to increase energy efficiency by using a first frequency of between 36 Hz and 45 Hz to provide the first predetermined airflow, and a second predetermined frequency that is no more than 51 Hz to provide the second maximum predetermined airflow;

an exhaust air-supplying means for supplying the airflow in the exhaust outlet;

said exhaust air-supplying means including a second fan or blower and a second three-phase AC motor;

the exhaust air-supplying means being controlled by an exhaust variable frequency drive controller;

said second AC motor having a maximum power output at a maximum frequency sixty hertz, and capable of providing less power at lower frequencies;

each of the second fan or blower and the second AC motor configured to increase energy efficiency by being oversized, the second fan or blower being oversized in rated maximum airflow and the first three phase AC motor being oversized in rated horsepower, both being oversized by compared to what would be needed to provide the second maximum predetermined airflow when the AC motor is supplied with AC at sixty hertz;

said exhaust variable frequency drive controller controlling the second AC motor configured to increase energy efficiency by using a first frequency of between 32 Hz and 40 Hz or 36 Hz and 45 Hz to provide the first predetermined airflow, and a second predetermined frequency that is between 37 Hz and 47 Hz to provide the second maximum predetermined airflow.

* * * * *